US006474243B1

(12) United States Patent
Grohse

(10) Patent No.: US 6,474,243 B1
(45) Date of Patent: Nov. 5, 2002

(54) ADJUSTABLE COMPUTER TABLE

(76) Inventor: Peter Grohse, Ulmer-Tor-Strasse 12, D-88400 Biberach (DE)

( * ) Notice: Subject to any disclaimer, the term of this patent is extended or adjusted under 35 U.S.C. 154(b) by 0 days.

(21) Appl. No.: 09/937,695

(22) PCT Filed: Feb. 6, 1999

(86) PCT No.: PCT/DE99/00320

§ 371 (c)(1),
(2), (4) Date: Sep. 28, 2001

(87) PCT Pub. No.: WO00/45667

PCT Pub. Date: Aug. 10, 2000

(30) Foreign Application Priority Data

Feb. 1, 1999 (DE) ..... 199 03 794

(51) Int. Cl.[7] ..... A47F 5/10
(52) U.S. Cl. ..... 108/10; 108/96; 108/50.01
(58) Field of Search ..... 108/1, 6, 7, 9, 108/10, 96, 106, 92, 50.01

(56) References Cited

U.S. PATENT DOCUMENTS 4,270,460 A * 6/1981 Husson ..... 108/3
4,566,741 A 1/1986 Eriksson et al.
4,751,884 A * 6/1988 Ball ..... 108/143
5,419,525 A * 5/1995 Hilton ..... 108/50.01

FOREIGN PATENT DOCUMENTS

| | | |
|---|---|---|
| DE | 297 03 173 | 6/1997 |
| EP | 0 721 749 | 7/1996 |

* cited by examiner

*Primary Examiner*—Beth A. Stephan
*Assistant Examiner*—Jerry A Anderson
(74) *Attorney, Agent, or Firm*—Collard & Roe, P.C.

(57) ABSTRACT

In an adjustable desktop for a personal computer, having a keyboard an a monitor, wherein the desk comprises a telescopic column supporting a top, the telescopic column having a static component and a mobile component, wherein an adjustment of different height levels of the desk's top is achieved by a relative movement of the mobile component with respect to the static component, the essentially the features that the monitor is supported by a platform connected to the desk's top, said platform being pivotable about an axle which is aligned parallel to the front edge of the desk's top, wherein an alteration of the pivoting angle of the platform with respect to the desk's top is achieved by way of a Bowden cable movable in response to an adjustment of height of the desk's top, have the effect that a pre-determined angle of inclination of the head of a user when looking on to a monitor screen is independent of a given adjustable height level of the desk's top and is therefore independent of any adjustment of the desk's top due to different body measures of a given user.

14 Claims, 2 Drawing Sheets

ADJUSTABLE COMPUTER TABLE

CROSS REFERENCE TO RELATED APPLICATIONS

Applicant claims priority under 35 U.S.C. §119 of German Application No. 199 03 794.9 filed Feb. 1, 1999. Applicant also claims priority under 35 U.S.C. §120 of PCT/DE99/00320 filed Feb. 6, 1999. The international application under PCT article 21(2) was not published in English.

BACKGROUND OF THE INVENTION

The invention relates to an adjustable desk for a personal computer, having a keyboard an a monitor, wherein the desk comprises a telescopic column supporting a top, the telescopic column having a static component and a mobile component, wherein an adjustment of different height levels of the desk's top is achieved by a relative movement of the mobile component with respect to the static component.

Desks of the above kind are being used in multiple ways as working stations for persons having different body measures. Even though the desks are mostly adjustable in height or that they are as such pivotable around a horizontal axis, they still have the disadvantage that an angle of inclination of the head of a user will change when the height of the desktop is adjusted for users having different body measures.

It is a purpose of the invention to provide a desk which makes it possible for users having different body measures, especially longer and shorter users, to use a personal computer and to look at the monitor screen of the personal computer all with the same inclination of their heads irrespective of an adjusted height level of the desk's top.

For a desk of the above mentioned kind the above problem is solved in that the monitor is supported by a platform connected to the desk's top, said platform being pivotable about an axle which is aligned parallel to the front edge of the desk's top, wherein an alteration of the pivoting angle of the platform with respect to the desk's top is achieved by way of a Bowden cable in response to an adjustment of a height level of the desktop.

SUMMARY OF THE INVENTION

In the desk according to the invention, the essential combination of claim elements, namely that the monitor is supported by a platform connected to the desk's top, said platform being pivotable about an axle which is aligned parallel to the front edge of the desk's top, wherein an alteration of the pivoting angle of the platform with respect to the desk's top is achieved by way of a Bowden cable in response to an adjustment of a height level of the desktop, have the effect that an adjustment a height level of the desktop, which always induces a relative movement of the moving component of the telescopic column with respect to the static component of the telescopic column, will automatically bring about a pivoting movement of the monitor platform about its axle by such an angle that the angle of inclination of the head of a user with respect to the monitor screen will be the same for any user, independent how long or how short he might be, via a coupling of the Bowden cable with the static component of the telescopic column on one end and with the platform on the other end, the platform being connected to the mobile component of the telescopic column via the desk's top.

According to a first preferred embodiment of the desk according to the invention, it is provided that the first end of the Bowden cable is connected to the static component of the telescopic column, and the second end of the Bowden cable is coupled with the platform, wherein it is essentially connected to so part of the platform via rolls. Thereby it is achieved that a relative movement of the mobile component of the telescopic column with respect to the static component of the telescopic column directly causes an alteration of the angle of the axle of the pivotable monitor platform.

The Bowden cable of the desk according to the invention preferably comprises a pulley. Thereby it is achieved that a wished alteration of the angle of inclination of the monitor platform can be achieved even for great differences of height levels of the top of the desk according to the invention.

According to a simple preferred embodiment of the desk according to the invention the pulley has a transmission ration of 1:10.

According to an important embodiment of the desk according to the invention, it is provided that a first end of the Bowden cable is connected to the static component of the telescopic column via a roll. Thereby it is achieved, that a predetermined change of height level of the top causes a twice as long change of elongation of the Bowden cable, thereby causing an over-proportional change of the angle of inclination of the monitor platform. Together with the provision of a pulley, this feature has the effect that the transmission ratio of the pulley can be reduced by half. Correspondingly, a pulley provided with this embodiment of the computer desk according to the invention has a transmission ratio of 1:5. With the computer desk according to the invention, a second end of the Bowden cable is preferably connected to a pin fastened on the monitor platform. Therein, the pin is preferably connected to the axle of the monitor platform. Thereby it is achieved that a change of the angle of inclination of the platform can be brought about by a change of the angle of inclination of the pin, wherein the pin can be shaped and dimensioned such that its one end connected to the other end of the Bowden cable can be provided in the vicinity of the Bowden cable, so that the Bowden cable may be shorter by a corresponding amount.

The Bowden cable and the pulley of the desk according to the invention are preferably provided with a cover in order to keep dust and dirt away and in order to prevent moving parts from getting into their immediate neighborhood, thereby impoverishing its motility and downgrading its function. Even with respect to the prevention of personal injury the provision of a cover is preferable.

The monitor platform of the desk according to the invention is preferably journaled underneath the surface of the desk's top. By this measure, an ergonomically preferable angle of inclination of the head of a user with respect to the monitor screen can be achieved in combination with an adjustment of the height levels of the desk's top, said angle of inclination being of advantage for the purpose of writing documents on the desk's top and for the purpose of using the keyboard located on the desk's top.

According to a further preferred embodiment of the desktop according to the invention it is provided that the pivoting axel of the monitor platform is provided on that side of the monitor platform facing a desk's user. Thereby it is achieved that the main mass and thereby the main part of the monitor's weight is located on that half side of the monitor platform facing away from a user of the desk, the monitor platform being divided into two halves or sides by the pivoting axle, whereby in turn it is achieved that the Bowden cable coupled with that half side of the monitor platform facing a user of the desktop is always straightened and tightened by the weight of the monitor so that an alteration of length of the Bowden cable always causes an alteration of the angle of the monitor platform.

The telescopic column of the desktop according to the invention is aligned vertically according to a simple embodiment of the present invention. According to a preferred embodiment of the desktop according to the invention the telescopic column is however inclined in a direction towards a user of the desktop in an angle of 10° to 14°. By way of this feature it is achieved that apart from a constant angle of inclination of the heads of different users of the desk having different body measures, even a constant distance between the eyes of a user and the monitor screen of a personal computer placed on the desk's top is given for users having different body measures, especially longer and shorter ones. This gives an extra viewing comfort.

According to a further preferred embodiment of the desktop according to the invention it is provided that the Bowden cable is guided by rolls provided on a supporting means connected with the mobile component of the telescopic column. By way of the supporting means connected with the mobile component, an especially effectively scalable further coupling of the Bowden cable with the mobile component of the telescopic column is achieved. Further, a roll for the Bowden cable may be placed on he supporting means.

BRIEF DESCRIPTION OF THE DRAWINGS

In the following the desk according to the invention is explained by way of a preferred embodiment thereof, which is depicted in drawings. Therein the figures show the following.

DETAILED DESCRIPTION

Figure 1:
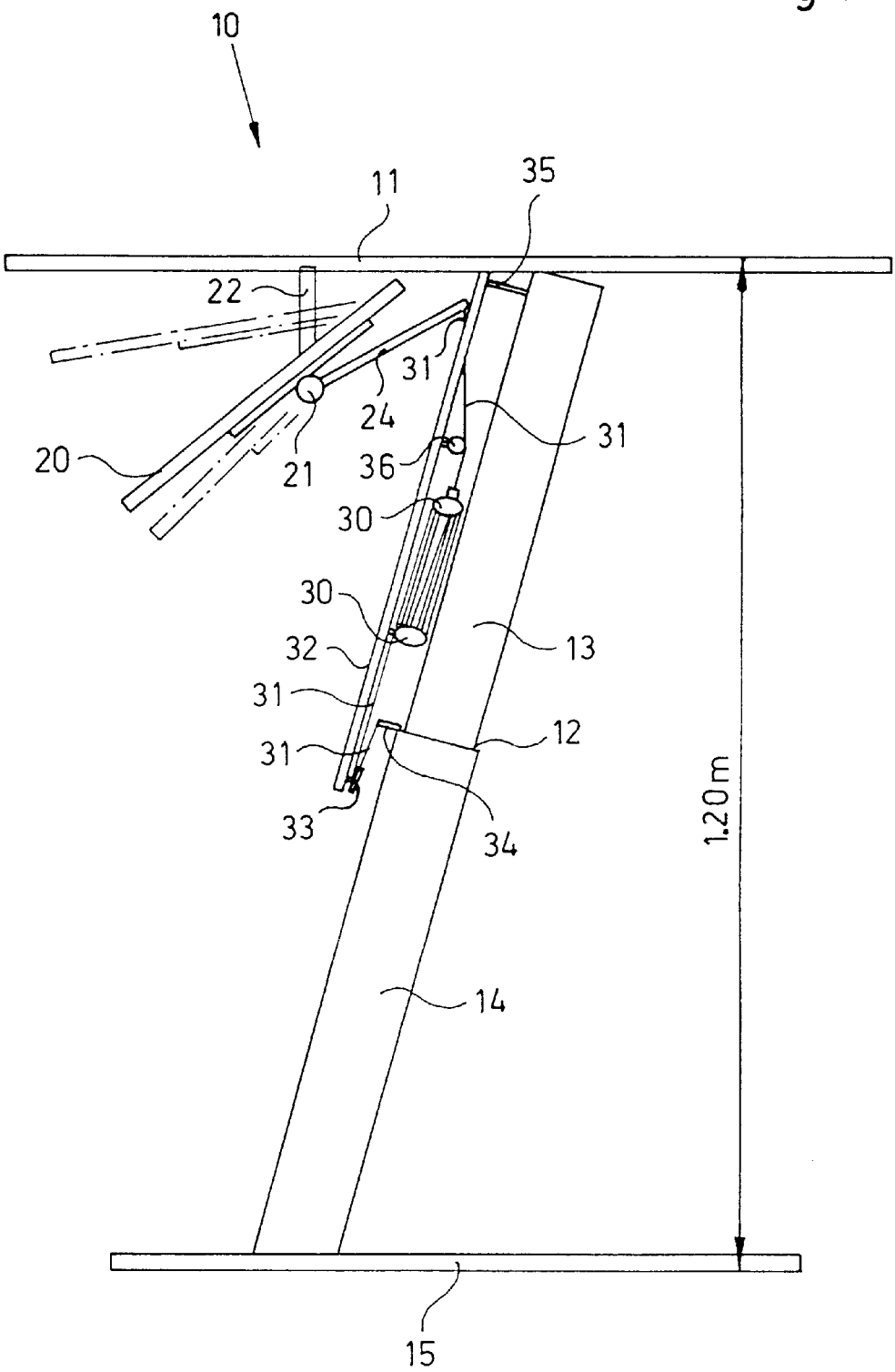
FIG. 1 a preferred embodiment of the desktop according to the invention in an extended state of the telescopic column, in a side elevation.
Figure 2:
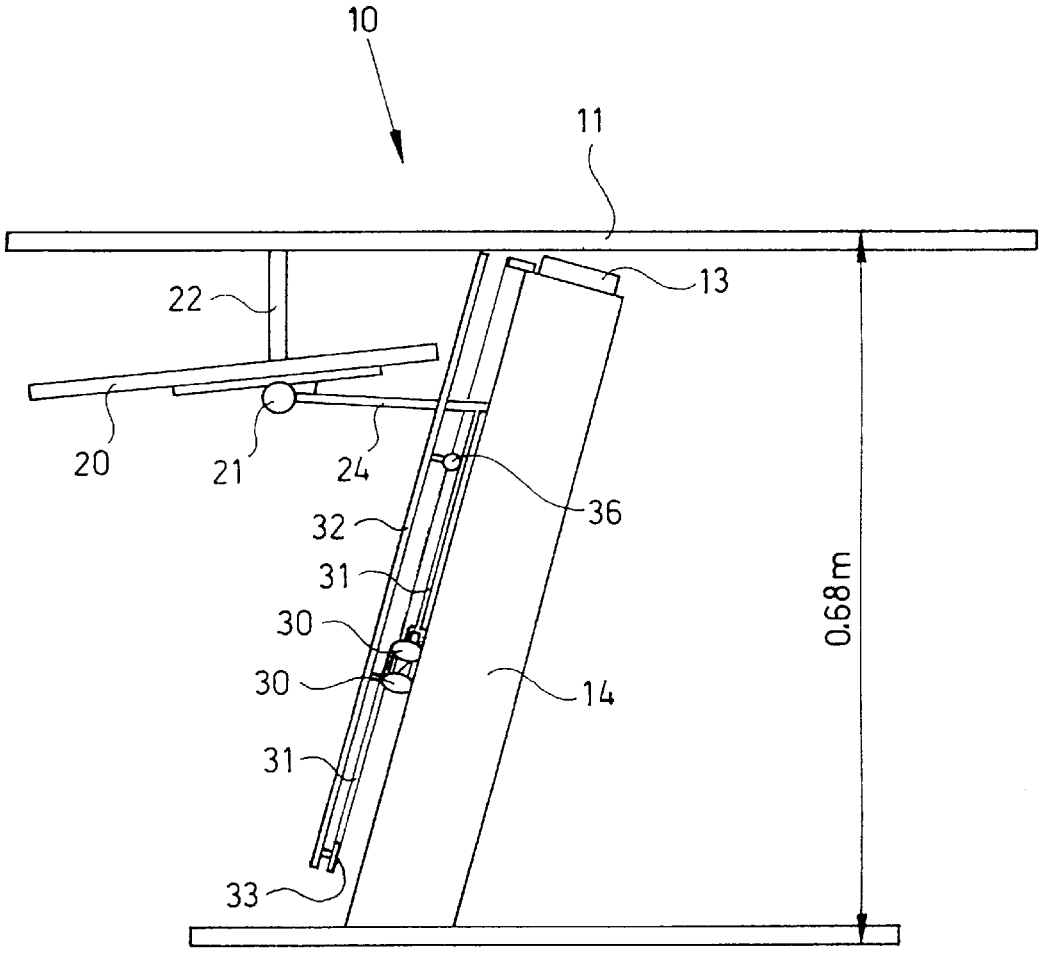
FIG. 2 the preferred embodiment of the desktop according to the invention shown in FIG. 1 in a non-extended state of the telescopic column, in a side elevation.

The desk 10 according to the invention shown in FIGS. 1 and 2 comprises a top 11, which is connected to a base construction 16 via a telescopic column 12 having a static component 14 and a mobile component 13. The adjustment of different height levels, i.e. different heights of the top 11 is achieved in that the mobile component 13 is reciprocatably extendable with respect to the static component 14 by means of a not depicted motor, which can be activated by a not depicted activating means. The telescopic column 12 is inclined in a direction towards a user of the computer desk in an angle of 10°, the user being seated to the right of the column 12 in the side elevations shown in the figures. Because of that angle of 10° with which the telescopic column 12 is aligned, upon activation of the none-depicted motor driving the telescopic column 12, a reciprocating up and down motion of the top 11 will result in a reciprocating fore and aft movement of top 11 with respect to a user.

The desk 10 according to the invention is conceptuated such that the keyboard of a personal computer would be located on the top 11 and that the monitor of a personal computer would be located on a monitor platform 20 which is pivotably journaled about a pivoting axle 21, the platform 20 being provided underneath the surface of the top 11. A non-moving part of the axle 21 is held in position by and fastened to one end of a pin 22, the other end of pin 22 being fastened to the top 11. A pin 24 is fastened to a moving part of the axle 21 of the monitor platform 20, providing that axle 21 and even the monitor platform 20 connected to it is pivotable via pin 24. Platform 20 in that way is pivotable into different positions having different angles with respect to top 11 by way of movement of pin 24.

For the purpose of pivoting the platform 20, a Bowden cable 31 having a pulley 30 is provided between that end of pin 24 apposing axle 21 and the upper end 34 of the static component 14 of the telescopic column 12. The Bowden cable 31 is guided over a roll 33 which is provided at the lower end of the supporting means 32, which is connected to the mobile component 13 of the telescopic column 12 via a clamping element 35. A portion of the Bowden cable 31 which is located above pulley 30. That portion of Bowden cable 31 is guided over a roll 36 which is also fastened to the supporting means 32. The pulley 30 has a gear transmission ration of 1:5.

As can be seen when interpreting FIGS. 1 and 2 together, a downward motion of the top 11 will cause an alteration of the angle between platform 20 and plate 11 in such a way that angle will be diminished. On the other hand, an upward motion of top 11, which is incurred by way of an extension of mobile component 13 out of the static component 14 of the telescopic column 12, will cause that the angle between platform 20 and plate 11 will increase in a predetermined way such that at any time the angle of inclination of the head of the user of the non-depicted personal computer will always be ergonomically in an optimal position with respect to the viewing screen of a monitor positioned on platform 20.

The above explained embodiment of the present invention has solely the purpose of a better understanding of the below given claims defining the scope of protection as well as the general concept of the present invention, which are in no way restricted to the above given preferred embodiment.

What is claimed is:

1. An adjustable desk for a personal computer, having a keyboard and a monitor, wherein the desk comprises a telescopic column supporting a top, the telescopic column having a static component and a mobile component, wherein an adjustment of different height levels of the desk's top is achieved by a relative movement of the mobile component with respect to the static component, characterized in that the monitor is supported by a platform connected to the desk's top, said platform being pivotable about an axle which is aligned parallel to a front edge of the desk's top, wherein an alteration of the pivoting angle of the platform with respect to the desk's top is achieved by way of a Bowden cable in response to an adjustment of a height level of the desktop.

2. Desk according to claim 1, characterized in that a first end of the Bowden cable is connected to the static component of the telescopic column, and a second end of the Bowden cable is coupled with the platform.

3. Desk according to claim 1, characterized in that the Bowden cable includes a pulley.

4. Desk according to claim 3, characterized in that the pulley has a transmission ratio of 1:10.

5. Desk according to claim 1, characterized in that a first end of the Bowden cable is connected to the static component of the telescopic column via a roll.

6. Desk according to claim 5, characterized in that the pulley has a transmission ratio of 1:5.

7. Desk according to claim 1, characterized in that a second end of the Bowden cable is connected to a pin fastened on the monitor platform.

8. Desk according to claim 1, characterized in that a pin is connected to the axle of the monitor platform.

9. Desk according to claim 3, characterized in that the pulley is provided with a cover.

10. Desk according to claim 1, characterized in that the monitor platform is journaled underneath the surface of the desk's top.

11. Desk according to claim 1, characterized in that the pivoting axle of the monitor platform is provided on that side of the monitor platform facing a desk's user.

12. Desk according to claim 1, characterized in that the telescopic column is aligned vertically.

13. Desk according to claim 1, characterized in that the telescopic column is inclined towards a desk's user at an angle of 10° to 14°.

14. Desk according to claim 1, characterized in that the Bowden cable is guided by rolls provided on a supporting means connected with the mobile component of the telescopic column.

* * * * *

UNITED STATES PATENT AND TRADEMARK OFFICE

CERTIFICATE OF CORRECTION

PATENT NO. : 6,474,243 B1
DATED : November 5, 2002
INVENTOR(S) : P. Grohse

It is certified that error appears in the above-identified patent and that said Letters Patent is hereby corrected as shown below:

Column 5,
Line 9, please change “pivoting” to -- pivot --.

Signed and Sealed this

Twenty-fourth Day of June, 2003

JAMES E. ROGAN
*Director of the United States Patent and Trademark Office*